US012630203B2

(12) United States Patent
Wang et al.

(10) Patent No.: US 12,630,203 B2
(45) Date of Patent: May 19, 2026

(54) TRAIN-GROUND INTERLOCKING METHOD AND SYSTEM FOR RAIL TRANSIT TRAIN OPERATION CONTROL

(71) Applicant: CASCO SIGNAL LTD., Shanghai (CN)

(72) Inventors: Xiaoyong Wang, Shanghai (CN); Liang Pan, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 780 days.

(21) Appl. No.: 18/003,496

(22) PCT Filed: Sep. 22, 2021

(86) PCT No.: PCT/CN2021/119532

§ 371 (c)(1),
(2) Date: Dec. 27, 2022

(87) PCT Pub. No.: WO2022/089096

PCT Pub. Date: May 5, 2022

(65) Prior Publication Data

US 2023/0242167 A1 Aug. 3, 2023

(30) Foreign Application Priority Data

Oct. 28, 2020 (CN) ..... 202011174482.4

(51) Int. Cl.
*B61L 27/20* (2022.01)
*B61L 11/00* (2006.01)
(Continued)

(52) U.S. Cl.
CPC ..... *B61L 27/20* (2022.01); *B61L 11/00* (2013.01); *B61L 11/02* (2013.01); *B61L 11/08* (2013.01);
(Continued)

(58) Field of Classification Search
CPC ..... B61L 27/20; B61L 27/30; B61L 27/40; B61L 27/04; B61L 19/06;
(Continued)

(56) References Cited

U.S. PATENT DOCUMENTS

2010/0299007 A1* 11/2010 Ghaly ..... B61L 15/0062 701/20
2015/0307119 A1* 10/2015 Ghaly ..... B61L 25/06 246/122 R
(Continued)

FOREIGN PATENT DOCUMENTS

CA 2850467 C * 7/2018 ..... B60L 15/40
CN 206125062 U * 4/2017
(Continued)

OTHER PUBLICATIONS

International Search Report (with English translation) and Written Opinion issued in PCT/CN2021/119532, dated Nov. 18, 2021, 10 pages provided.

*Primary Examiner* — S. Joseph Morano
*Assistant Examiner* — James William Jones
(74) *Attorney, Agent, or Firm* — HSML P.C.

(57) ABSTRACT

The present disclosure relates to a train-ground interlocking method and system for rail transit train operation control. In the train-ground interlocking method, a train is taken as a subject of wayside and carborne resource management, and the train actively calculates a required resource according to a "movement mission", applies to a wayside at an appropriate time and location, uses the resource after obtaining a resource use authority, and actively releases the resource after use of the resource; and once the wayside allocates the resource to one of other trains, the resource cannot be reallocated without being released by the train. Compared to the prior art, the present disclosure has the following advantages: interlocking control of integration of the train and
(Continued)

wayside equipment is achieved, rail transit is improved from original passive and indirect interlocking control of the train to active and direct interlocking control of the train, the train safety protection function and the utilization efficiency of wayside resources are further improved, and safe, timely and appropriate match between a movement behavior of the train and a status of the wayside equipment is truly realized.

11 Claims, 2 Drawing Sheets

(51) Int. Cl.

| | |
|---|---|
| ***B61L 11/02*** | (2006.01) |
| ***B61L 11/08*** | (2006.01) |
| ***B61L 15/00*** | (2006.01) |
| ***B61L 19/06*** | (2006.01) |
| ***B61L 27/04*** | (2006.01) |
| ***B61L 27/30*** | (2022.01) |
| ***B61L 27/40*** | (2022.01) |

(52) U.S. Cl.
CPC ..... *B61L 15/00* (2013.01); *B61L 15/0027* (2013.01); *B61L 19/06* (2013.01); *B61L 27/04* (2013.01); *B61L 27/30* (2022.01); *B61L 27/40* (2022.01); *B61L 2019/065* (2013.01); *B61L 2027/202* (2022.01); *B61L 2027/204* (2022.01); *B61L 2201/00* (2013.01)

(58) Field of Classification Search
CPC ..... B61L 2019/065; B61L 2027/202; B61L 2027/204; B61L 2201/00; B61L 11/08; B61L 11/086; B61L 11/02; B61L 11/00; B61L 15/0027; B61L 15/00
USPC ..... 246/3
See application file for complete search history.

(56) References Cited

U.S. PATENT DOCUMENTS

| | | | | |
|---|---|---|---|---|
| 2017/0113707 | A1* | 4/2017 | Ghaly | B61L 27/20 |
| 2019/0071106 | A1* | 3/2019 | Carlson | B61L 15/0027 |
| 2019/0144024 | A1* | 5/2019 | Schmidt | B61L 27/20<br>246/115 |
| 2019/0263432 | A1* | 8/2019 | Carlson | B61L 27/70 |

FOREIGN PATENT DOCUMENTS

| | | | | | |
|---|---|---|---|---|---|
| CN | 106926871 | A | * | 7/2017 | B61L 27/04 |
| CN | 107472300 | A | * | 12/2017 | B61L 23/18 |
| CN | 109677456 | A | * | 4/2019 | B61L 27/20 |
| CN | 110104031 | A | * | 8/2019 | B61L 27/20 |
| CN | 110901693 | A | * | 3/2020 | B61L 27/20 |
| CN | 111776013 | A | | 10/2020 | |
| CN | 112429045 | A | | 3/2021 | |
| EP | 3225500 | A1 | * | 10/2017 | B61L 27/04 |
| KR | 20170056084 | A | * | 5/2017 | B61L 23/00 |
| WO | WO-2018021606 | A1 | * | 2/2018 | B61L 27/04 |

* cited by examiner

TRAIN-GROUND INTERLOCKING METHOD AND SYSTEM FOR RAIL TRANSIT TRAIN OPERATION CONTROL

TECHNICAL FIELD

The present disclosure relates to the field of rail transit train operation control, including but not limited to a track circuit based train control (TBTC) system, a communication based train control (CBTC) system, a train autonomous control system (TACS), a Chinese train control system (CTCS), and a European train control system (ETCS), in particular to a train-ground interlocking method and system for rail transit train operation control actively managed by a train.

BACKGROUND

An existing system for rail transit train operation control protects safe operation of a train by means of computer interlocking, wayside automatic train protection (ATP), and carborne ATP, in which an interlocking relationship between equipment or facilities is implemented by the computer interlocking and is provided to the carborne ATP by the wayside ATP. Such implementation method has the advantages that the functions of interlocking, wayside ATP, and carborne ATP are divided in a relatively independent way, but there is also a very obvious defect, that is, the interlocking relationship is only controlled at a wayside, while the subject (the train) that needs to be protected cannot be directly involved. There is a scene where an interlocking status may be inconsistent with an actual behavior of the train, which is not conducive to safety protection of train operation.

SUMMARY

To overcome the defect existing in the prior art, an objective of the present disclosure is to provide a train-ground interlocking method and system for rail transit train operation control actively managed by a train, which realize a train safety protection function and a train automatic drive function, and truly achieve the consistency between a movement behavior of the train and an interlocking status.

The objective of the present disclosure may be achieved through the following technical solution:

According to one aspect of the present disclosure, provided is a train-ground interlocking method for rail transit train operation control, the method being applied to a system for rail transit train operation control, where the system for rail transit train operation control includes but is not limited to a track circuit based train control (TBTC) system, a communication based train control (CBTC) system, a train autonomous control system (TACS), a Chinese train control system (CTCS), and a European train control system (ETCS); and in the train-ground interlocking method, a train is taken as a subject of wayside and carborne resource management, and the train actively calculates a required resource according to a "movement mission", applies to a wayside at an appropriate time and location, uses the resource after obtaining a resource use authority, and actively releases the resource after use of the resource; and once the wayside allocates the resource to one of other trains, the resource cannot be reallocated without being released by the train.

Preferably, the method specifically includes the following steps:

Step 1: actively initiating, by a carborne controller (CC), an interlocking request for equipment or facilities to be interlocked to an information control (IC) according to a location of the train and a movement plan;

Step 2: querying, by the IC, statuses of the equipment requested according to the request of the CC, allocating, controlling and locking the equipment according to the statuses of the equipment, and returning the statuses to the CC initiating the request after locking;

Step 3: once allocation and locking statuses of the equipment are given, allocated and locked equipment being incapable of changing the statuses by themselves or changing the statuses by the IC before the CC requests for release;

Step 4: requesting for, by the CC, a return condition of the statuses of the equipment according to an interlocking relationship of ICs to determine whether the train may safely operate and pass through corresponding zones;

Step 5: after the train passes through the corresponding zones, actively applying, by the CC, to the IC for releasing locking statuses of the corresponding equipment according to the location of the train; and Step 6: after the IC receives the application for release of the corresponding equipment, immediately removing, by the IC, an interlocking relationship of the equipment requested, and recovering unlocking statuses of the equipment.

Preferably, the interlocking relationship in the Step 1 is a mutual correlation and restriction relationship between wayside and carborne equipment or facilities to be used, included in an interlocking relationship range.

Preferably, allocating and locking the equipment in the Step 2 specifically includes the following steps:

Step 2.1: after the IC receives a resource application, sending, by the IC, control commands of the corresponding equipment to an object controller (OC);

Step 2.2: driving, by the OC, wayside equipment and re-collecting the statuses of the equipment, and sending, by the OC, the statuses of the equipment to the IC; and Step 2.3: synchronously sending, by the IC, the allocation and locking statuses of the equipment to the CC and an automatic train supervision (ATS) system, and calculating, by the CC, a movement authority according to the locking statuses, to control train operation.

Preferably, the allocated and locked equipment in the Step 3 can only be dedicated to the CC obtaining allocation.

According to another aspect of the present disclosure, provided is a train-ground interlocking system for rail transit train operation control, the system being connected to a dispatching system, where the dispatching system includes an ATS system or a centralized traffic control (CTC) system; the train-ground interlocking system includes an IC, an OC, a CC, and a balise; and the CC is communicatively connected to the ATS system or the CTC system of the dispatching system, the IC, and the balise, respectively, the IC is communicatively connected to the OC, and the OC is communicatively connected to the balise.

Preferably, the IC is a carborne information control or a wayside information control.

Preferably, the CC is configured to actively calculate equipment or facilities to be passed and interlocked according to a location of a current train and a movement mission path, and to request to the IC for locking the corresponding equipment or facilities.

Preferably, the CC is configured to actively request to the IC for unlocking corresponding equipment or facilities according to a location of a current train and a use condition of an obtained resource.

Preferably, the IC is configured to query, allocate and lock statuses of equipment or facilities according to a request of the CC, and to perform release according to the request.

Compared to the prior art, the present disclosure has the following advantages:

1. The train actively determines the equipment or facilities to be interlocked, which improves the utilization rate of the equipment or facilities, avoids the problem of excessive interlocking or early interlocking in the prior art, and achieves locking on demand and locking on use.

2. After the equipment or facilities are locked, only the train requesting for interlocking can perform active release when there is no external manual intervention, which is superior to the way of indirectly determining the behavior of the train by using the wayside detection equipment for unlocking in the prior art, and fundamentally avoids the problem of incorrect unlocking.

DETAILED DESCRIPTION OF THE EMBODIMENTS

The technical solutions in the embodiments of the present invention will be clearly and completely described below with reference to the accompanying drawings in the embodiments of the present disclosure. Apparently, the described embodiments are part rather than all of the embodiments of the present disclosure. All other embodiments obtained by those of ordinary skill in the art based on the embodiments of the present disclosure without creative efforts should fall within the scope of protection of the present disclosure.

To further improve safety protection of train operation, the present disclosure provides a train-ground interlocking method and system for rail transit train operation control, in which a train is taken as a direct control object of an interlocking relationship to participate in the whole process of interlocking operation, so as to truly achieve the consistency between a movement behavior of the train and an interlocking status. This method may be used for a train-to-train communication based train autonomous control system (TACS), and may also be used for a communication based train control (CBTC) system. The use of this method in similar train operation control systems and signal systems including these systems is also within the scope of the claims of the present disclosure.

Figure 1:
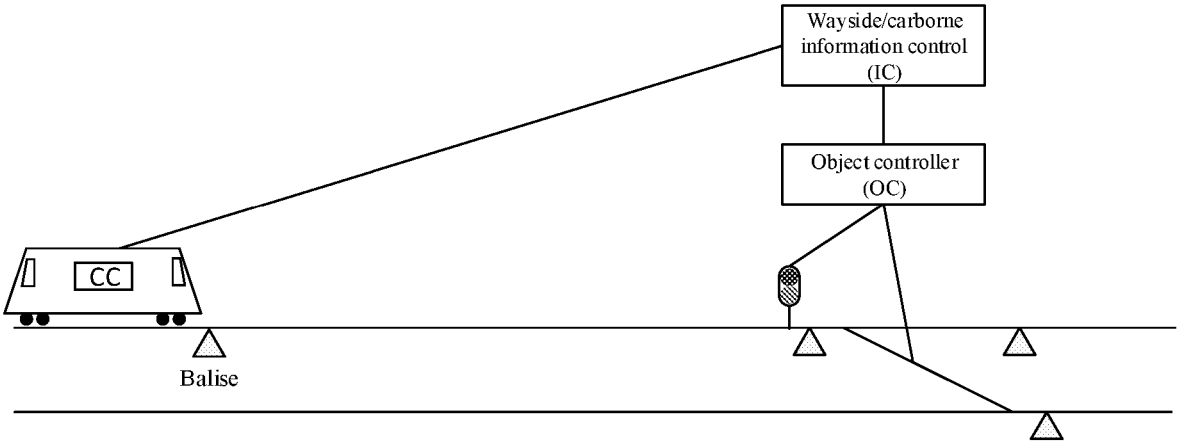
FIG. 1 is a schematic structural diagram of a train-ground interlocking system for train operation control in the present disclosure.

As shown in FIG. 1, a train-ground interlocking system for rail transit train operation control includes a wayside/carborne information control (IC), an object controller (OC), a carborne controller (CC), and a balise. The CC plans an operation path and calculates interlocked equipment or facilities that need to be passed according to a location of a current train, and requests to the IC for locking and releasing the corresponding equipment; the IC queries, allocates and locks statuses of the equipment or facilities according to the request of the CC, and performs release according to the request; the OC is configured to implement status collection and drive of wayside equipment; and the balise is responsible for providing location information in combination with a line map.

Figure 2:
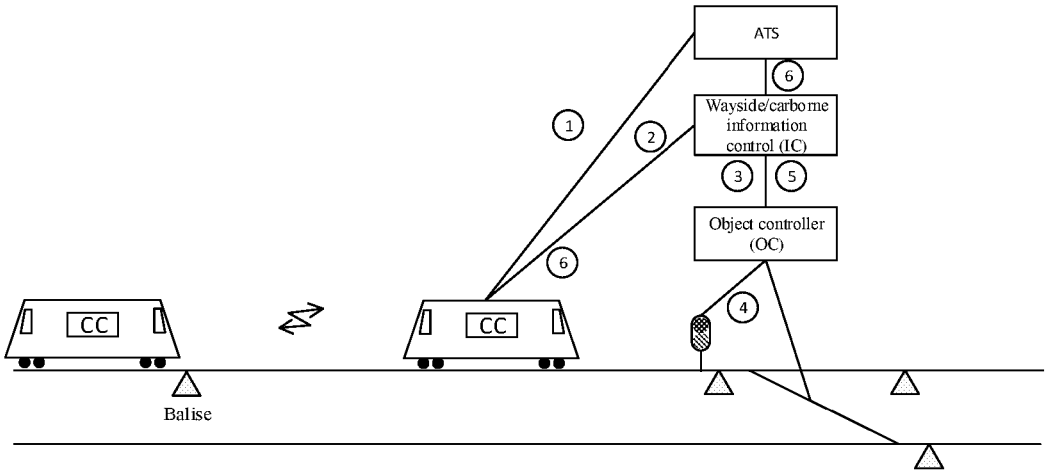
FIG. 2 is a schematic complete data flow diagram of the train-ground interlocking system for train operation control in the present disclosure.

As shown in FIG. 2, a train-ground interlocking method for rail transit train operation control includes the following steps:

Step 1: actively initiating, by a CC, an interlocking relationship request for wayside and carborne equipment or facilities to be used to an IC on a basis of a location of a train and an operation plan;

Step 2: querying, by the IC, statuses of the equipment requested according to the interlocking relationship request of the CC, locking the related equipment in a case of meeting an interlocking condition, and returning allocation and locking statuses to the CC initiating the request;

Step 3: once the allocation and locking statuses of the equipment or facilities are given, allocated and locked equipment being incapable of changing the statuses by themselves or changing the statuses by the IC before the CC requests for release, namely, the equipment or facilities being only dedicated to the CC obtaining allocation;

Step 4: requesting for, by the CC, a return condition of the statuses of the equipment or facilities according to an interlocking relationship of ICs to determine whether the train may safely operate and pass through corresponding zones;

Step 5: after the train passes through the corresponding zones, actively applying, by the CC, to the IC for releasing locking statuses of the corresponding equipment or facilities according to the location of the train; and Step 6: after the IC receives the application for release of the corresponding equipment or facilities, immediately removing, by the IC, an interlocking relationship of the equipment requested, and recovering unlocking statuses of the equipment.

Figure 3:
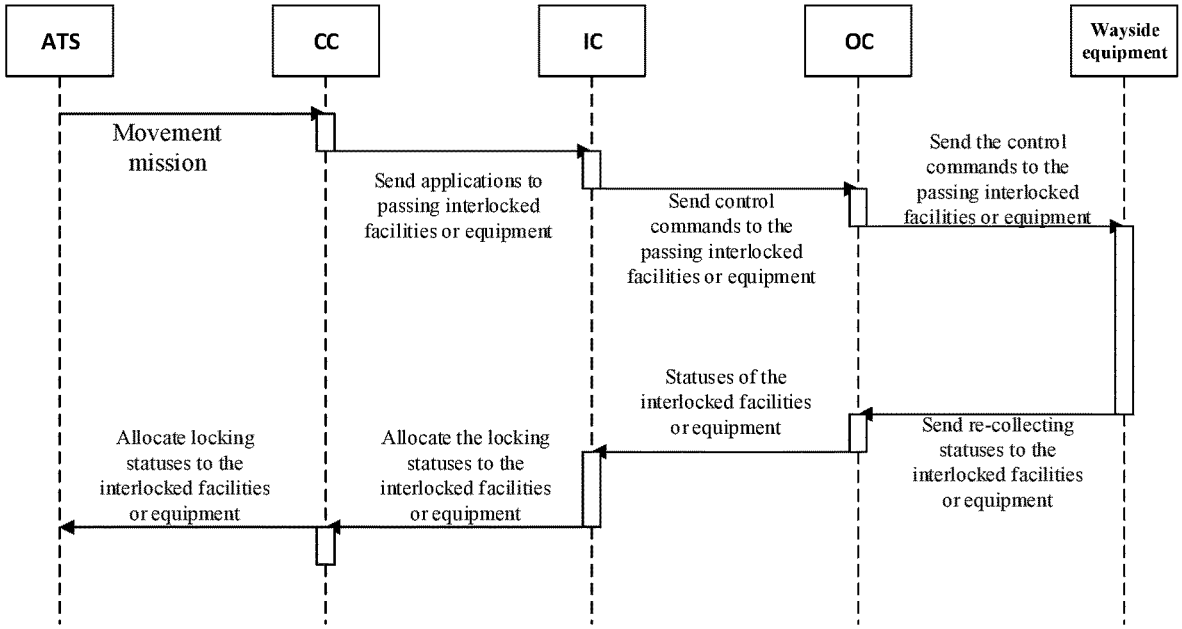
FIG. 3 is a time sequence diagram of allocating and locking train-ground interlocked facilities or equipment for train operation control in the present disclosure.

As shown in FIG. 3, allocating and locking the equipment in the Step 2 specifically includes the following steps:

Step 2.1: after the IC receives a resource application, sending, by the IC, control commands of the corresponding equipment or facilities to an OC;

Step 2.2: driving, by the OC, wayside equipment and re-collecting the statuses of the equipment, and sending, by the OC, the statuses of the equipment to the IC; and Step 2.3: synchronously sending, by the IC, the allocation and locking statuses of the equipment or facilities to the CC and an automatic train supervision (ATS) system, and calculating, by the CC, a movement authority according to the locking statuses, to control train operation.

Figure 4:
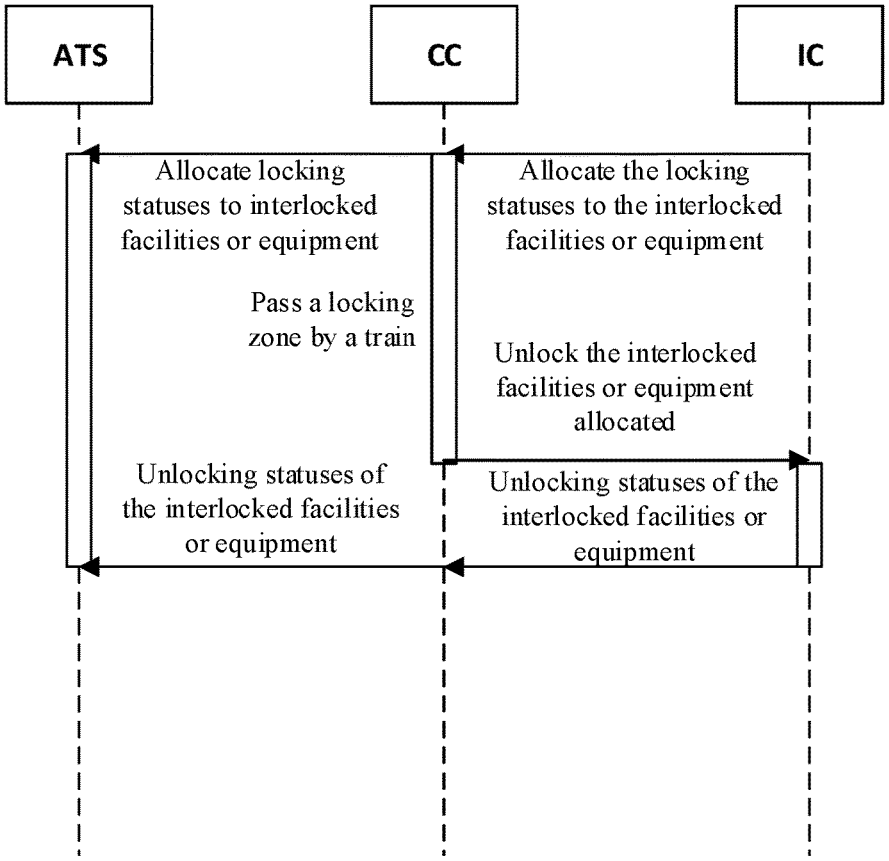
FIG. 4 is a time sequence diagram of unlocking the train-ground interlocked facilities or equipment for train operation control in the present disclosure.

As shown in FIG. 4, after the train operates to pass through a locking zone, the CC requests to the wayside/carborne information control for unlocking the corresponding locked equipment or facilities in the passed zone according to the location of the current train, and the information control receives the unlocking request to unlock the corresponding equipment.

Through the above process, the present disclosure has the following beneficial effects: interlocking control of integration of the train and the wayside equipment is achieved, rail transit is improved from original passive and indirect interlocking control of the train to active and direct interlocking control of the train, the train safety protection function and the utilization efficiency of wayside resources are further improved, and safe, timely and appropriate match between the movement behavior of the train and the status of the wayside equipment is truly realized.

The above is only the specific implementation of the present disclosure, but the scope of protection of the present disclosure is not limited thereto. Any of those skilled in the art may easily think of various equivalent modifications or substitutions within the technical scope of the present disclosure, and these modifications or substitutions should be included in the scope of protection of the present disclosure. Therefore, the scope of protection of the present disclosure should be subject to the appended claims.

The invention claimed is:

1. A train-ground interlocking method for rail transit train operation control, the method being applied to a system for rail transit train operation control, wherein the system for rail transit train operation control comprises but is not limited to one of a track circuit based train control (TBTC) system, a communication based train control (CBTC) system, a train autonomous control system (TACS), a Chinese train control system (CTCS), and a European train control system (ETCS); and in the train-ground interlocking method, a train is taken as a subject of wayside and carborne resource management, and the train actively calculates a required resource according to a movement task "movement mission", applies to the resources from a wayside at an appropriate time and location, uses the resource after obtaining a resource use authority, and actively releases the resource after use of the resource; and once the wayside allocates the resource to one of other trains, the resource cannot be reallocated without being released by the train, wherein the method comprises the following steps:

Step 1: actively initiating, by a carborne controller (CC), an interlocking request for equipment or facilities to be interlocked to an information control (IC) at the wayside according to a location of the train and a movement plan;

Step 2: querying, by the IC, statuses of the equipment requested according to the request of the CC, allocating, controlling and locking the equipment according to the statuses of the equipment, and returning the statuses to the CC initiating the request after locking;

Step 3: once allocation and locking statuses of the equipment are given, allocated and locked equipment being incapable of changing the statuses by themselves or changing the statuses by the IC before the CC requests for release;

Step 4: requesting for, by the CC, a return condition of the statuses of the equipment according to an interlocking relationship of ICs to determine whether the train may safely operate and pass through corresponding zones;

Step 5: after the train passes through the corresponding zones, actively applying, by the CC, to the IC for releasing locking statuses of the corresponding equipment according to the location of the train; and Step 6: after the IC receives the application for release of the corresponding equipment, immediately removing, by the IC, an interlocking relationship of the equipment requested, and recovering unlocking statuses of the equipment.

2. The train-ground interlocking method for rail transit train operation control according to claim 1, wherein the interlocking relationship in Step 1 is a mutual correlation and restriction relationship between wayside and carborne equipment or facilities to be used, included in an interlocking relationship range.

3. The train-ground interlocking method for rail transit train operation control according to claim 1, wherein allocating and locking the equipment in Step 2 specifically comprises the following steps:

Step 2.1: after the IC receives a resource application, sending, by the IC, control commands of the corresponding equipment to an object controller (OC);

Step 2.2: driving, by the OC, wayside equipment and re-collecting the statuses of the equipment, and sending, by the OC, the statuses of the equipment to the IC; and Step 2.3: synchronously sending, by the IC, the allocation and locking statuses of the equipment to the CC and an automatic train supervision (ATS) system, and calculating, by the CC, a movement authority according to the locking statuses, to control train operation.

4. The train-ground interlocking method for rail transit train operation control according to claim 1, wherein the allocated and locked equipment in Step 3 can only be dedicated to the CC obtaining allocation.

5. The train-ground interlocking method for rail transit train operation control according to claim 1, wherein Step 6 further includes sending, by the IC, the unlocking statuses of the equipment to the CC and to an automatic train supervision (ATS) system.

6. The train-ground interlocking method for rail transit train operation control according to claim 1, wherein an automatic train supervision (ATS) system is in direct communication with the CC.

7. A train-ground interlocking system for the train-ground interlocking method for rail transit train operation control according to claim 1, the system being connected to a dispatching system, wherein the dispatching system comprises an ATS system or a centralized traffic control (CTC) system; the train-ground interlocking system comprises an IC, an OC, a CC, and a balise; and the CC is communicatively connected to the ATS system or the CTC system of the dispatching system, the IC, and the balise, respectively, the IC is communicatively connected to the OC, and the OC is communicatively connected to the balise.

8. The train-ground interlocking system for rail transit train operation control according to claim 7, wherein the IC is a carborne information control or a wayside information control.

9. The train-ground interlocking system for rail transit train operation control according to claim 7, wherein the CC is configured to actively calculate equipment or facilities to be passed and interlocked according to a location of a current train and a movement mission path of the movement task, and to request to the IC for locking the corresponding equipment or facilities.

10. The train-ground interlocking system for rail transit train operation control according to claim 7, wherein the CC is configured to actively request to the IC for unlocking corresponding equipment or facilities according to a location of a current train and a use condition of an obtained resource.

11. The train-ground interlocking system for rail transit train operation control according to claim 7, wherein the IC is configured to query, allocate and lock statuses of equipment or facilities according to a request of the CC, and to perform release according to the request.

* * * * *